United States Patent [19]

Geiger

[11] 4,345,410

[45] Aug. 24, 1982

[54] CONSTRUCTION METHOD

[76] Inventor: David Geiger, Rye, N.Y.

[21] Appl. No.: 178,803

[22] Filed: Aug. 18, 1980

[51] Int. Cl.[3] ..... E04B 1/34

[52] U.S. Cl. ..... 52/741; 52/2; 52/296; 52/80

[58] Field of Search ..... 52/2, 80, 83, 86, 741, 52/63, 127, 296

[56] References Cited

U.S. PATENT DOCUMENTS

| | | | |
|---|---|---|---|
| 3,574,981 | 4/1971 | Hemschen | 52/127 |
| 3,613,322 | 10/1971 | Czarnecki, Sr. | 52/83 |
| 3,772,836 | 11/1973 | Geiger | 52/80 |
| 3,835,599 | 9/1974 | Geiger | 52/80 X |
| 3,841,038 | 10/1974 | Geiger | 52/80 |
| 4,079,556 | 3/1978 | Luck et al. | 52/127 |
| 4,158,941 | 6/1979 | Diana | 52/741 |

*Primary Examiner*—Carl D. Friedman

*Attorney, Agent, or Firm*—Arthur V. Smith; Pasquale A. Razzano

[57] ABSTRACT

A method for erecting the supporting wall of a domed structure is disclosed in which a peripheral foundation for the wall is formed conforming in plan generally to the periphery of the structure and has hollow box columns positioned thereon at predetermined points. The lower ends of the columns are secured to the foundation at a plurality of points with temporary moment connections for the purpose of resisting load moments during the erection procedure. Wall panels are secured to the columns to close the sides of the structure and a supporting ring formed of a plurality of pre-cast segments is secured to the top of the columns. After the ring is completed and supported the temporary moment connections at the lower ends of the columns are released to leave only pin connections at the column bases whereby the entire wall structure acts as a complete structural unit. The dome, typically an air-supported fabric dome, is erected on the ring with its structural elements, namely cables, secured to the ring.

17 Claims, 12 Drawing Figures

48
66
56
52
44
52a
52b
58
22a
50
74
22b
20

24
22
20
64
2a
2
1
1/3
1/3
10
16
18
14
12

42
18

44
16
44
46
90
6
66
70
58
6
60
72
64
62
68
18

30
32
26
28
28
12
28

CONSTRUCTION METHOD

The present invention relates to large dome structures, and in particular to structures having peripheral structural walls which support a dome providing large, clear interior spaces.

Dome structures of the type with which applicant is concerned, such as for example the dome structures shown in U.S. Pat. Nos. 3,772,836; 3,835,599; 3,841,038 and develop extremely large stresses at the periphery of the dome which are transmitted to a peripheral ring in the structure. If the dome is an air supported dome structure, then the ring is a compression ring, whereas if the dome is a rigid structure the ring becomes a tension ring. In either case, the stresses in the ring must be resisted and supported by a foundation structure. In U.S. Pat. No. 3,835,599, the dome structure has a peripheral compression ring which forms the foundation for the structure and rests on an earthen berm.

In more recent developments however, it has been found desirable to provide dome structures of this type with a peripheral wall for supporting the compression or tension ring. A peripheral wall will provide the structure with greater height and thus provide increased seating capacity where the structure is used as athletic stadium. However, the wall structure must transmit the vertical reactions of the compression or tension ring of the dome to the foundation. Thus, special design considerations in both the erection procedure and in the completed structure must be dealt with.

It is an object of the present invention to provide an improved peripheral wall structure for a dome building.

Another object of the present invention is to provide an improved method of erecting the peripheral wall of a dome structure.

A still further object of the present invention is to provide an improved wall erection method for an air inflated dome structure.

Yet another object of the present invention is to provide an improved ring structure for the tension and/or compression ring of a dome structure.

A still further object of the present invention is to provide a condensation drainage system for a dome structure.

Yet another object of the present invention is to provide an improved cable mounting arrangement for an air inflated dome.

The above, other objects, features and advantages of the invention will be apparent in the following detailed description of an illustrative embodiment thereof, which is to be read in connection with the accompanying drawings, wherein.

Figures 1, 2, 2A, 3:
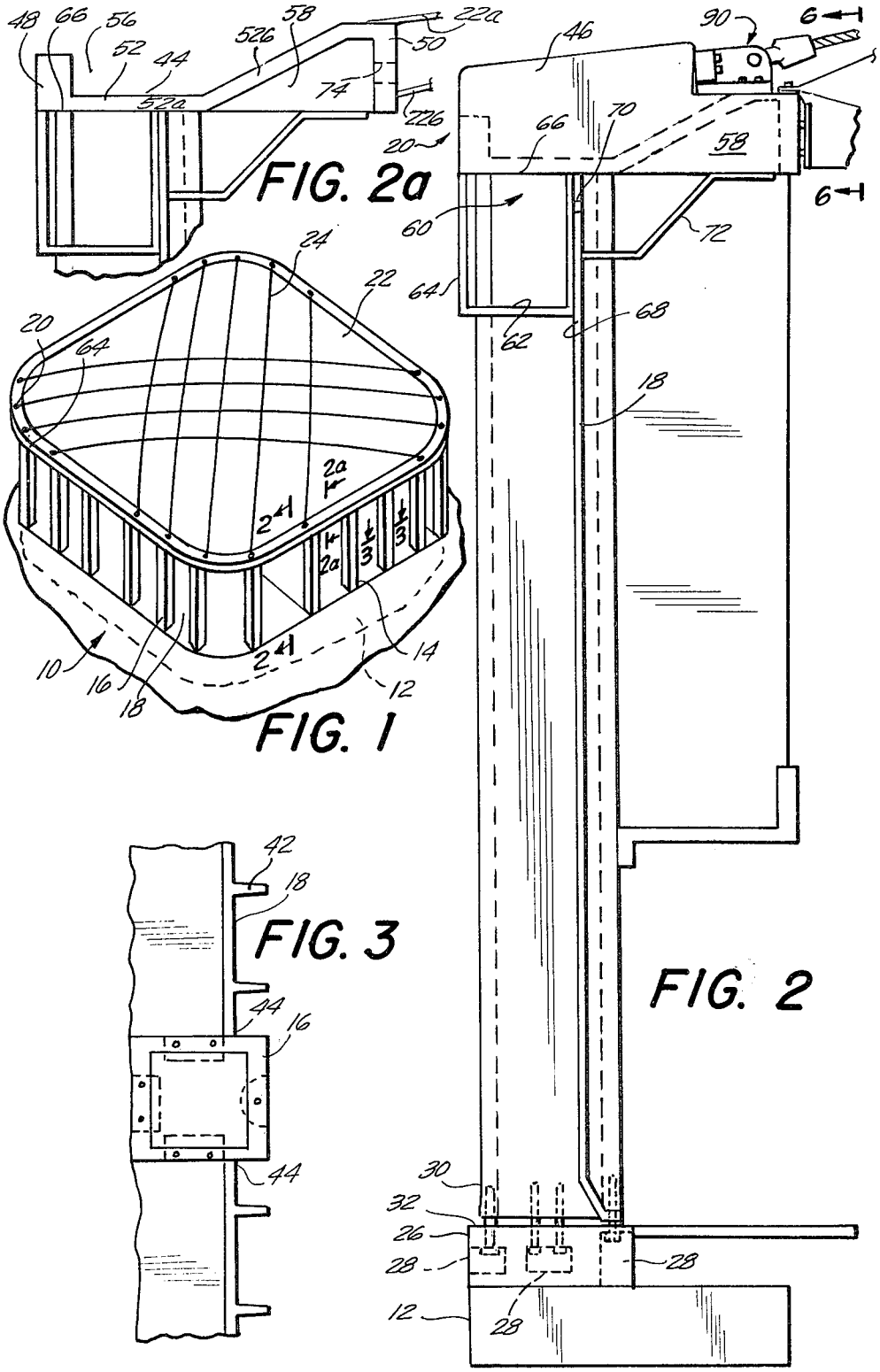
FIG. 1 is a perspective view of an air supported dome structure constructed in accordance with the present invention.
FIG. 2 is a cross-sectional view taken along line 2—2 of the wall and foundation structure of the building shown in FIG. 1.
FIG. 2A is a cross-sectional view taken along line 2A—2A of FIG. 1 showing the cross-section of the compression ring in the building of FIG. 1.
FIG. 3 is a sectional view taken along line 3—3 of FIG. 1 showing the relationship of a wall column and wall panel in the building of FIG. 1.

Referring now to the drawings in detail, and initially to FIG. 1 thereof, an air supported dome structure 10, constructed in accordance with the present invention is illustrated. The building includes a foundation 12 on which a peripheral wall 14 is supported. The wall consists of a plurality of columns 16 and intermediate wall panels 18. The upper ends of the column support a compression ring 20, more fully described hereinafter. Ring 20 in turn supports the dome 22 which consists, in the preferred embodiment of the invention, of a pair of air supported flexible membrane elements restrained by cables 24. The dome structure and cable array are, in the preferred embodiment of the invention, constructed and arranged according to the teachings of U.S. Pat. No. 3,835,599.

Although the illustrative embodiment of the invention is directed specifically to an air supported dome structure, the construction of the peripheral side wall of the structure as well as the ring at the top of the side wall is equally applicable to a rigid dome structure wherein the ring is a tension ring, as will be understood by those skilled in the art.

In the illustrative embodiment of the invention, columns 16 are hollow box columns, as illustrated in FIGS. 2 and 3. These columns may be integrally cast in one piece, or they may be formed of two generally U-shaped column sections laced together to form an integral column using the conventional techniques of the construction industry. In either case, the columns are the first structural element of the building above the foundation which are erected. Foundation 12 itself is a conventional foundation of any convenient construction and includes a support pad 26 for each of the columns 16 to be secured to the foundation. These support pads each have access cavities 28 formed therein about their periphery, for purposes to be described hereinafter.

Figure 3A:
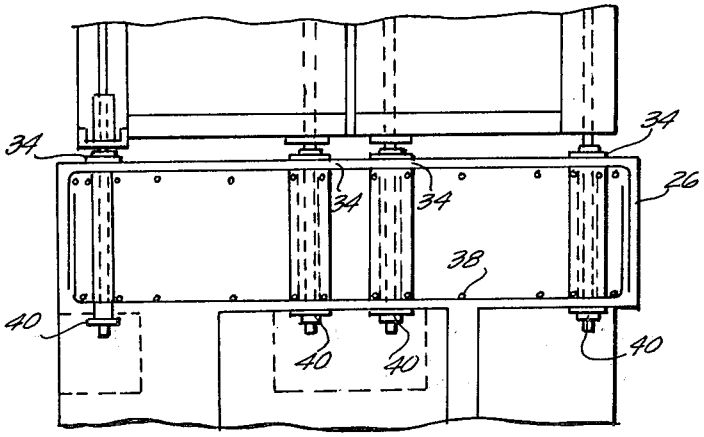
FIG. 3A is an enlarged cross-sectional view of the base connection for the columns used in the wall structure of FIGS. 1 and 2.

Each of the columns 16 has an upper and lower end, and may be provided with reinforcing rods along their length. At least some of their rods (7 in the illustrative embodiments) have threaded lower free-end portions 32. These ends of the rods or bolts (see FIG. 3A) are inserted in apertures 34 formed in the cast concrete pads 26 which are reinforced with conventional reinforcing rods 38. The threaded ends of rods 32 extend through the apertures or sleeves 34 in pads 26 into the cavities 28 thereof to form a temporary moment connection between the column and the foundation. This connection is made by the use of nuts 40 threaded on the ends of the rods in cavities 28 to form a rigid connection between the column and the foundation so that the column can resist wind loads during the erection procedure.

Once all of the columns are assembled in this manner, wall panels 18 are secured in position between the columns. In the illustrative embodiment of the invention, wall panels 18 are planar elements having projecting reinforcing flanges 42 extending inwardly of the building. The ends 44 of the panels are laced to the columns to form an integral structure in any known manner using, for example, concrete grout, or the like. The panels serve to form a substantially air-tight peripheral wall for the building so that the building can retain the air pressure used to support dome 22. The temporary moment connection provided at the base of the columns serves to resist wind loads applied to the wall panels and the entire building structure during the erection procedure since the tops of the columns, at this stage of the construction project are unrestrained and would be free to sway when subject to wind loads.

Once the columns and wall panels have been erected the compression ring 20 is installed. Ring 20 consists of a plurality of ring segments 44, extending between the columns. The segments are formed of precast concrete with their ends located adjacent their respectively associated columns. Once positioned, a reinforcing and connecting rib 46 is cast in place at each column between adjacent ring segments in order to tie the ring segments together and to the column. The specific techniques of casting connecting rib 46 to the column and the ring segments are known construction techniques and need not be described in detail.

Figure 3B:
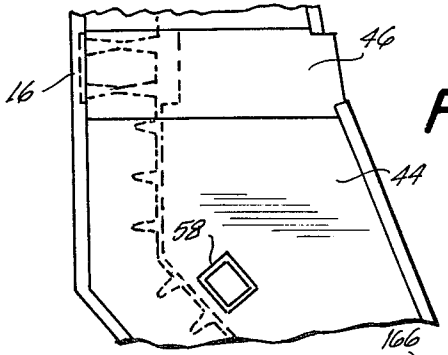

The ring segments themselves have a unique cross-sectional configuration. As seen in FIGS. 2 and 2A, each ring segment includes an exterior wall or panel 48 and an interior wall or panel 50. A base panel 52 extends between the inner and outer wall panels of the ring. This base includes a first section **52*a* which is relatively flat and extends from the lower edge of the ring wall 48 to about the midpoint of the width of the segment. From there the base panel 52 includes an inclined segment 52*b* which extends up to an is integrally formed with the upper end of the inner ring wall 50. By this arrangement a catch basin 56 is formed on the upper outer side of the ring segment for receiving rain water and snow melt and diverting the water to discharge drains such as, for example, the drain opening 58 shown in FIG. 3B. Additionally, an inner air plenum 59** is formed which serves to distribute air between the dome membranes, as described hereinafter.

As mentioned, columns 16 are hollow box columns. The hollow opening or channel in each of the columns serves as an air distribution channel from air supply equipment located in or adjacent the building. The air supply equipment is connected to one or more of the columns in any convenient manner to provide pressurized air thereto. The air flows towards the upper end of the columns which have openings 60 formed therein. Air passing from openings 60 enters an outer plenum 62 which is formed by an L-shaped plenum member 64. This L-shaped member is a precast concrete member that is secured to the base 52 of the ring segments and to the exterior surface 68 of wall panels 18. The plenum also provides a pleasing appearance to the structure by producing the appearance of a broad rim about the building.

Wall panels 18 have openings 70 formed therein at predetermined locations so that air in plenum 62 can pass therefrom to the interior of the building and to air chamber 59. The latter is closed by a sheet metal panel 72 secured to the ring segments and the walls in any convenient manner so that air flows into and is retained in plenum 59. From the plenum, the air passes out of ports 74 formed in the front wall 50 of the ring segments. These ports are located to be between the upper and lower membrane elements **22*a*, 52*b***. The air supplied between the membranes helps in keeping the membranes separated and in reducing condensation formed therebetween. These spaced membranes have been used in the past to provide additional insulation and light diffusion in air supported dome structures.

Once all of the ring segments are in position and the compression ring is completed, the dome 22 is assembled. As described in the above-mentioned patents, the air supported dome structure consists of a flexible membrane restrained by a plurality of cables. The cables are anchored at their ends to the compression ring. In the present invention, the cable anchors are located at the ribs 46 on certain of the columns 16 about the periphery of the building.

Figure 4:
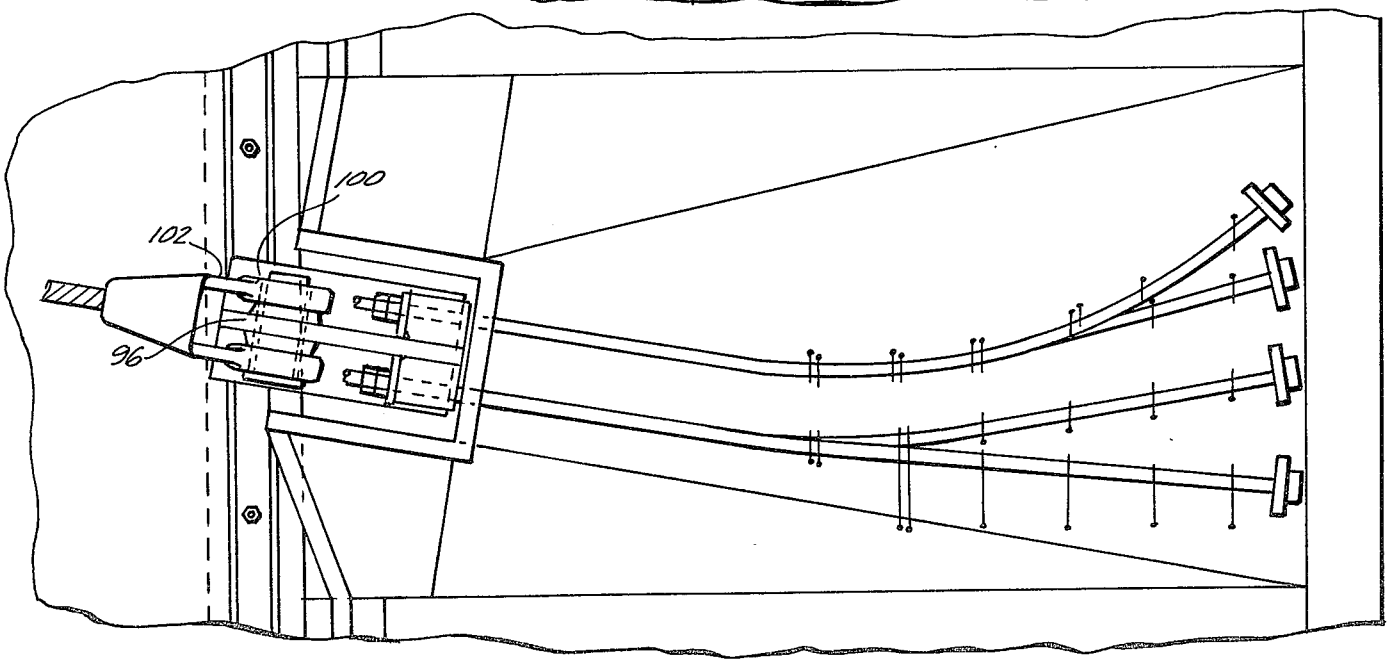
FIG. 4 is a top plan view of a typical cable anchor used in the building of the present invention.
Figure 5:
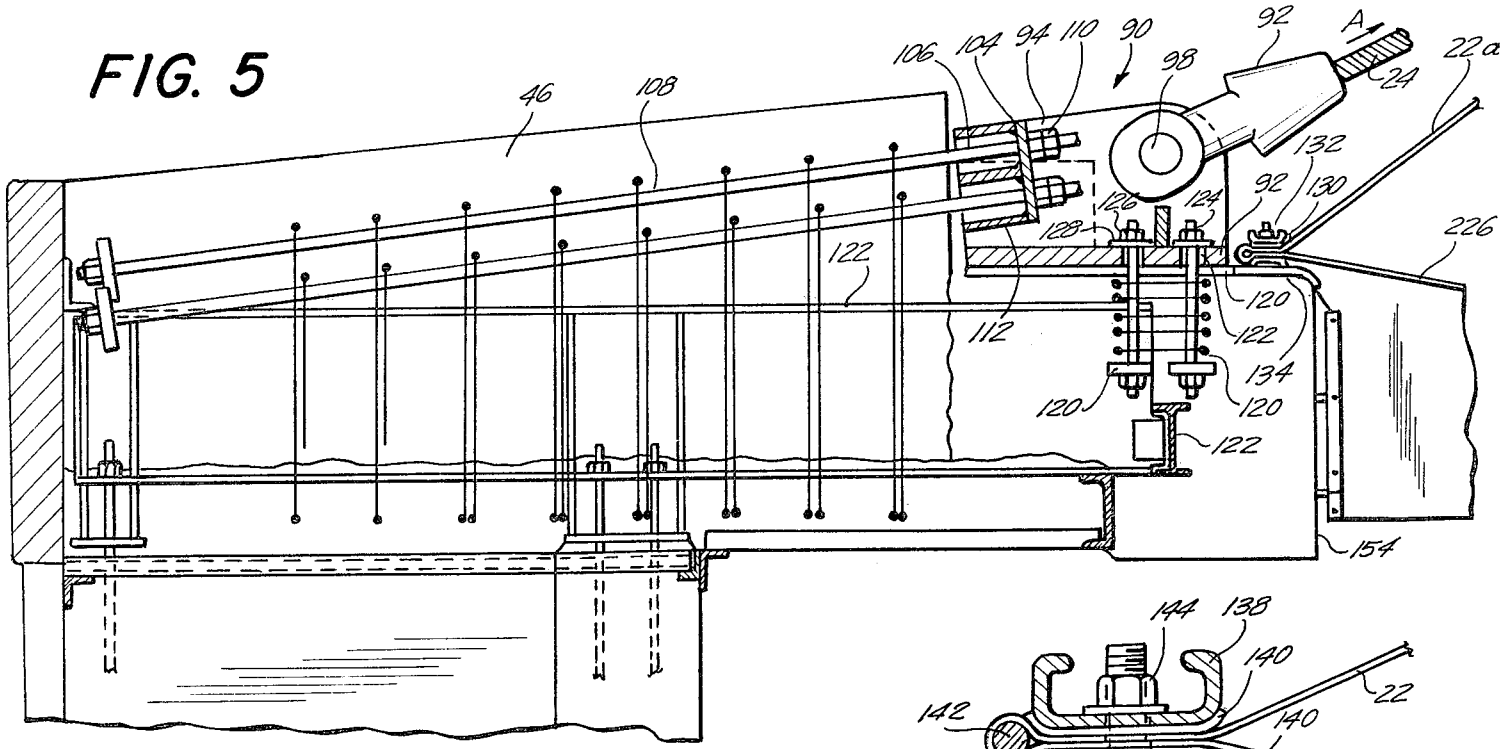
FIG. 5 is a cross-sectional view taken along line 5—5 of FIG. 4 showing the adjustable cable anchor of the invention.

Cable anchors 90 are illustrated in greater detail in FIGS. 4 and 5 and include a cable socket 92 rigidly secured to the end of the cable 24 to provide the connection between the cable and the remainder of anchor 90 which is also referred to in the art as a weldment. In accordance with the present invention this weldment consists of a base plate 92 on which a vertically extending flange 94 is secured by welding or the like. This flange has an opening 96 formed therein which receives a pivot pin 98. The pin extends through opening 96 into the openings 100 in the legs 102 of socket 92, thereby providing a pivotal connection between the end of the cable and the weldment.

In accordance with the present invention, weldment 90 is adjustably mounted on the compression ring to permit adjustment of the tension in the cables and thereby insure proper positioning of the various structural elements of the dome. In order to permit this adjustment, flange 94 is provided with a pair of perpendicularly extending flanges 104 having apertures therein which receive the threaded ends 106 of a plurality of reinforcing rods 108. These reinforcing rods extend into rib 46 and are cast in place with the rib. The ends 106 of reinforcing rods 108 are threaded and nuts 110 are secured to the threaded ends of the rods on the sides of flanges 104 opposite the concrete rib. If desired, annular collars 112 may be welded to the flanges 104 on the back sides thereof to protect the threads of the rods during the concrete pouring operation. As the tension in the cable 24 tends to pull the cable and thus the weldment in the direction of the arrow A in FIG. 5, it will be appreciated that nuts 110 resist that movement in the weldment. Also, by adjusting the position of the nuts, the position of the weldment, and thus the tension in the cable, will be adjusted.

As will be apparent from FIG. 5, the stress in the cable applies some upward force to the weldment. This is resisted by anchor bolts 120, which are embedded in the concrete rib. In this regard, the rib itself is reinforced by one or more "I" beams 122 or the like, in any convenient manner.

Bolts 120 extend upwardly through elongated slots 122 in the base 92 of the weldment. Their threaded free ends 124 are engaged with nuts 126 and washers 128, to retain the weldment in its flat horizontal position. After the longitudinal position of the weldment is adjusted by the nuts 110, the nuts 126 are tightened to lock the weldment in position. The weldment, if desired, may be grouted with grout 130 or the like. The final adjustment to the positions of the weldments is made after the dome is erected and inflated.

Figure 7:
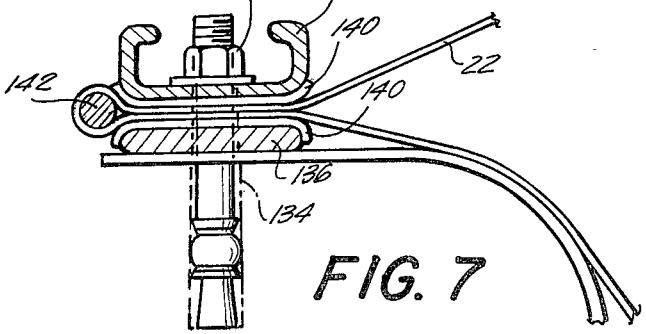
FIG. 7 is an enlarged cross-sectional view taken along line 7—7 of FIG. 6 showing the membrane clamp used for the upper membrane of the air inflated dome.
Figure 7A:
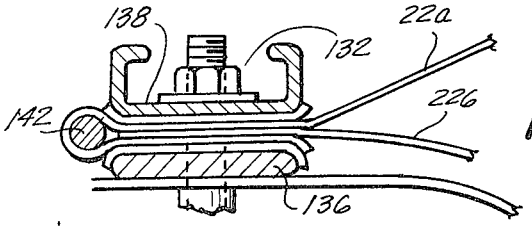
FIG. 7A is a sectional view taken along line 7A—7A of FIG. 6 showing the clamping of both the upper and lower membrane of the dome at the cable anchor.

As mentioned, dome 22 consists of upper and lower or outer and inner membrane elements. The outer membrane **22*a* is secured along its peripheral edge 130 by a clamp structure 132 shown in greater detail in FIG. 7 to the top edge 134 of ring 20. The clamp consists of a plurality of bolts 134 anchored in the ring and extending upwardly through a pair of clamp plates 136, 138. A pair of resilient pads 140 protect membrane 22*a* between the clamp elements 136, 138. As illustrated in FIG. 7, the membrane is turned about a bolt rope 142 with the free ends sewn together about the rope. Nuts 144 are tightened down on bolts 134 to form the clamp. At the location of the cables the lower or inner membrane 22*b* is also received in the same clamp 132. As seen in FIG. 7A, at that location the edge of the lower membrane 22*b* is sandwiched between the layers of the membrane 22*a* at clamp elements 136, 138**.

Figure 6:
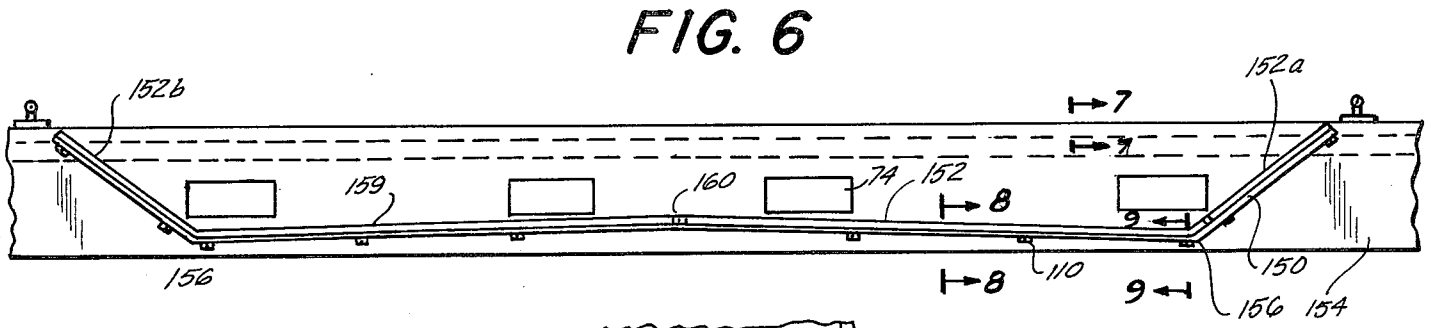
FIG. 6 is a front elevational view taken along line 6—6 of FIG. 2 showing the condensation drainage system of the invention.
Figure 9:
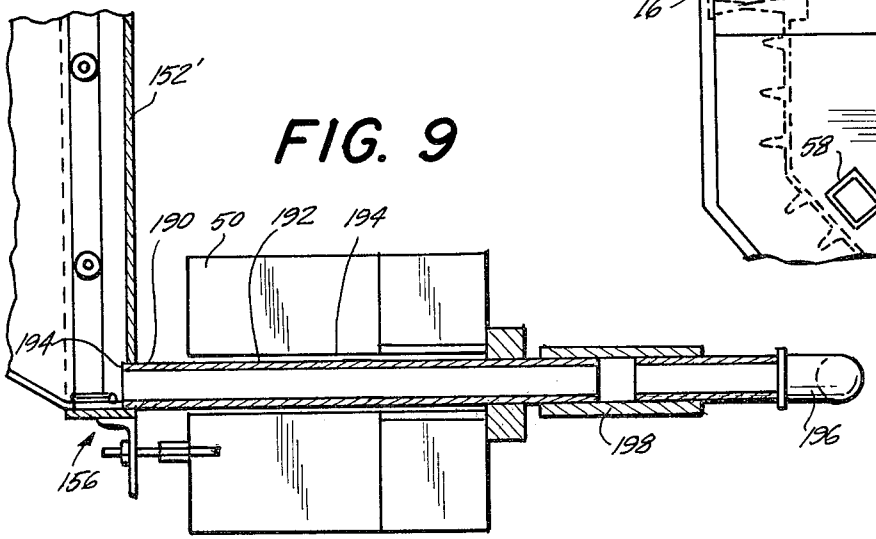
FIG. 9 is a sectional view taken along line 9—9 of FIG. 6 showing the condensation discharge for the drainage system.

Between the cable anchors the lower membrane is supported by a combination drainage and clamping system 150, shown in FIGS. 6 and 9. This system consists of a drainage element 152 which, in the illustrative embodiment of the invention, is a series of angle elements that are mounted on the front face 154 of the ring segments. As illustrated in FIG. 6, a pair of angle elements **152*a*, 152*b* extend from adjacent the cable anchors downwardly to low points 156. From there, additional angle elements 158*a* and 158*b* extend upwardly slightly to an intermediate point 160** at approximately the center line between adjacent cable anchors.

Figure 8:
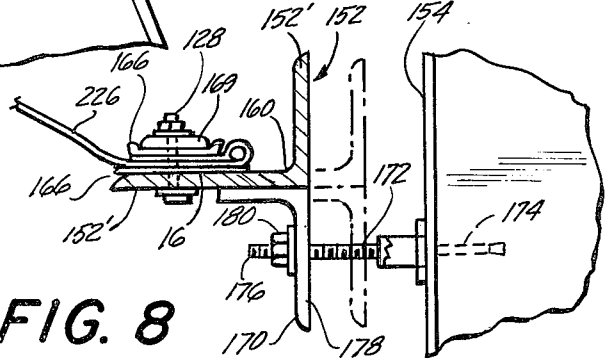
FIG. 8 is a cross-sectional view taken along line 8—8 of FIG. 6 showing the membrane clamp for the lower membrane and the drainage system of the present invention.

As seen in FIG. 8 angle elements 152 have a first leg 152' which extends generally parallel to the front face 154 of the ring and a leg 152" which extends perpendicularly therefrom. The legs cooperate to define a drainage channel 160 therebetween. The inner end of membrane **22*b* is clamped to leg 152" by a clamp 162 which is similar to the clamp 132 and includes a clamp element or rib 164 and a pair of resilient cushion members 166 between which the turned over edge of the membrane 22*b* is sandwiched. The clamp element 164 is tightened against flange 152" by a bolt and nut assembly 168**.

The various angles are supported on the front face of the rib by mounting angle elements 170. Each of these elements is a small angle element, slidably engaged with a bolt 172 having one end 174 embedded and anchored in the face of the ring. The other end 176 thereof is threaded and extends through the vertical flange 178 of angle 170 into engagement with a nut 180. Because the membrane **22*b* is under tension it will pull angle 152, which is welded to angle segments 170, away from the front face of the ring so that flange 178 engages against the nut and washer assembly 180. The position of the nut limits the outward movement of the angle 152. By adjusting nut 180** the position of the angle and thus the tension in the membrane can be adjusted.

When the building is in use, it is possible that condensation will form on the inner surface of the upper membrane under certain weather conditions. This condensation will accumulate and fall onto the upper surface of the inner membrane. From there it will gravitate towards the end of the membrane, into channel 160. The channels 160 of each of the angles guide the condensed water to the low points 156 of the clamp assemblies, shown in FIG. 6. At each of these points a drainage arrangement 190 is provided. This drainage arrangement consists of a tube 192 extending through an opening or sleeve 194 formed in the front panel 50 of each of the ring segments. The tube has a free end 194 engaged in the leg 152' of the adjacent angle 152. Water gravitating to the low point 156 of the assembly enters the tube 190 and passes to a drainage pipe 196. The drainage pipe is connected to the tube 190 by a flexible coupling or tube 198 or the like, which compensates for lateral movement of the angle 152 upon adjustment of the assembly 180. The drain 196 is lead to any waste drain system in the building as may be convenient.

After the entire building is erected, and the dome is inflated, by the introduction of pressurized air into the building, the temporary moment connections at the base of the columns in the peripheral wall structure may be released so that the columns can act as conventional pinned columns to resist the loads on the building. To achieve this, the nut assemblies 40 on bolts 34 along the two lateral sides and the outer side of the columns are released. This leaves the one bolt assembly on the inner face of each of the columns connecting the columns to the foundation, achieving the desired pin connection for the columns. As the columns are now supported on the foundation at their lower ends and by the compression ring at their upper ends, the building structure acts as an integral unit to resist wind loads.

Accordingly, it is seen that a relatively simple construction and procedure is provided for erecting a dome building structure. The technique permits the use of lightweight hollow box columns and precast wall panel construction which is temporarily secured to the foundation in a convenient manner for resisting loads during the erection procedure. Upon completion of the erection procedure, the temporary moment connections are released, so that the building acts as an integral structural element. In addition, an improved cable anchorage arrangement is provided that permits adjustment of the cable tension after erection of the building. And, a condensation drainage system is provided which serves the dual purpose of anchoring the membranes of the dome while draining condensation therefrom.

Although an illustrative embodiment of the invention has been described herein with reference to the accompanying drawings it is to be understood that the invention is not limited to that precise embodiment, and that various changes and modifications may be effected therein by one skilled in the art without departing from the scope or spirit of this invention.

What is claimed is:

1. A method for erecting the supporting wall of a dome structure comprising the steps of forming a peripheral foundation for the wall conforming in plan generally to the periphery of the structure, positioning hollow box columns on said foundation at predetermined points, securing the lower ends of each of said columns to said foundation at a plurality of points about each column with temporary moment connections to resist load moments during the erection procedure, securing wall panels to said columns between the columns to close the sides of the structure; securing a supporting ring to the tops of said columns, releasing said temporary moment connections at the lower ends of said columns and thereafter erecting the dome on the ring.

2. The method as defined in claim 1 including the step of mounting an air distribution plenum on said columns beneath said ring segments on the exterior of the structure.

3. The method as defined in claim 1 wherein said step of securing the columns to the foundation comprises the step of bolting each said column to the foundation along all of its sides.

4. The method as defined in claim 3 wherein said releasing step comprises releasing all the bolted connections on the column except those on the side having in common the rotation axis of the exterior wall.

5. The method as defined in claim 1 wherein said wall panels are aligned with the face of the columns containing the unreleased moment connections.

6. The method as defined in claim 1 wherein the step of securing the supporting ring to said columns comprises the step of securing a plurality of precast ring segments between the columns.

7. The method as defined in claim 6 including the step of forming a structural support rib in between predetermined ring segments at predetermined columns and securing the structural members of the dome to said support rib.

8. A method for erecting a dome structure comprising the steps of forming a peripheral foundation for the structure conforming in plan generally to the periphery of the completed structure; erecting a peripheral supporting wall for the dome of the structure by securing the lower ends of a plurality of columns to said foundation with temporary moment connections capable of resisting erection wind loads; securing wall panels to and between said columns; and securing a dome support ring to the upper ends of said columns; thereafter erecting a dome on said support ring by securing structural elements of the dome to said ring at at least some of said columns; and, after erection of said dome, releasing said temporary moment connections.

9. The method as defined in claim 8 wherein said step of erecting said dome comprises forming an air supported dome having cable members spanning across the structure; said support ring thereby constituting a compression ring.

10. The method as defined in claim 9 wherein said air supported dome includes a pair of membrane layers defining air passages therebetween and said ring includes an air distribution chamber communicating with said air passages for supplying air thereto.

11. The method as defined in claim 10 including the step of forming an air distribution plenum about the exterior of said building beneath said ring and between said columns, said wall panels being perforated to provide communication between said plenum and said air distribution chamber.

12. The method as defined in claim 11 wherein said columns are hollow and are in air communication with said plenum.

13. The method as defined in claim 9 wherein said step of securing the columns to said foundation with temporary moment connections comprises the step of bolting each said column to the foundation along all of its sides.

14. The method as defined in claim 13 wherein said releasing step comprises releasing all the bolted connections on the column except those on the side having in common the rotation axis of the exterior wall.

15. The method as defined in claim 14 wherein said wall panels are aligned with the face of the columns containing the unreleased moment connections.

16. The method as defined in claim 15 wherein the step of securing the supporting ring to said columns comprises the step of securing a plurality of precast ring segments between the columns.

17. The method as defined in claim 16 including the step of forming a structural support rib between predetermined ring segments at predetermined columns; and adjustably securing said cable members to said ribs.

* * * * *